US006716358B2

(12) United States Patent
Varadaraj

(10) Patent No.: US 6,716,358 B2
(45) Date of Patent: Apr. 6, 2004

(54) DEMULSIFICATION OF WATER-IN-OIL EMULSIONS

(75) Inventor: Ramesh Varadaraj, Flemington, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/353,735

(22) Filed: Jan. 28, 2003

(65) Prior Publication Data

US 2003/0155307 A1 Aug. 21, 2003

Related U.S. Application Data

(62) Division of application No. 09/803,575, filed on Mar. 9, 2001, now Pat. No. 6,555,009.

(51) Int. Cl.[7] ..... B01D 17/05

(52) U.S. Cl. ..... 210/708; 73/61.45; 204/157.15; 210/709; 210/732; 210/748; 436/139; 436/177; 516/143

(58) Field of Search ..... 73/324, 61.45, 73/61.49; 204/157.15, 164, 157.62; 210/708, 709, 748, 732, 787; 516/143; 436/139, 177

(56) References Cited

U.S. PATENT DOCUMENTS

| | | | | | |
|---|---|---|---|---|---|
| 2,257,997 | A | | 10/1941 | Barnes | 252/349 |
| 2,864,502 | A | | 12/1958 | May | 210/72 |
| 3,255,571 | A | | 6/1966 | Walker et al. | 55/9 |
| 3,699,051 | A | | 10/1972 | Sampson | 252/344 |
| 4,283,290 | A | * | 8/1981 | Davies | 210/643 |
| 4,384,977 | A | * | 5/1983 | Duke | 516/163 |
| 4,734,205 | A | * | 3/1988 | Jacques et al. | 210/708 |
| 4,737,265 | A | * | 4/1988 | Merchant et al. | 208/188 |
| 5,251,488 | A | * | 10/1993 | Haberman et al. | 73/861.04 |
| 5,487,300 | A | * | 1/1996 | Brackett et al. | 73/61.59 |
| 5,538,628 | A | * | 7/1996 | Logan | 210/198.1 |
| H1568 | H | * | 8/1996 | Huang et al. | 210/748 |
| 5,885,424 | A | | 3/1999 | Davis et al. | 204/157.42 |
| 5,951,456 | A | * | 9/1999 | Scott | 516/195 |
| 6,117,682 | A | * | 9/2000 | Lynn et al. | 436/29 |

FOREIGN PATENT DOCUMENTS

| | | | |
|---|---|---|---|
| WO | WO 96/05272 | 2/1996 | C10G/33/04 |

* cited by examiner

*Primary Examiner*—Peter A. Hruskoci
(74) *Attorney, Agent, or Firm*—Ramesh Varadaraj; Estelle C. Bakun

(57) ABSTRACT

The invention includes a method for demulsification of water-in-oil emulsions.

19 Claims, No Drawings

DEMULSIFICATION OF WATER-IN-OIL EMULSIONS

This is a Divisional Application of U.S. Ser. No. 09/803,575 filed Mar. 9, 2001 now U.S. Pat. No. 6,555,009.

FIELD OF THE INVENTION

The invention includes a method for demulsification of water-in-oil emulsions using sonication and recovering oil therefrom. The invention also includes a method for determining the strength of an interfacial film formed at the oil-water interface. The oil of the emulsion can be of any type including crude oils, crude oil distillates, vegetable oils, animal oils, synthetic oils and mixtures thereof.

BACKGROUND OF THE INVENTION

High TAN and asphaltene content crude oils possess the tendency to form stable water-in-crude oil emulsions. Such crude oil typically contains from about 1 to about 60 volume % water. The polar naphthenic acids and asphaltenes in the crude oil stabilize dispersed water droplets. Further, submicron size solids like silica and clay, when present in the crude oil, interact with the polar acids and asphaltenes and enhance the stability of the emulsions formed. Formation of stable water-in-crude oil emulsions result in difficulty in separation of water and crude oil. In most cases, known technologies for separation result in an intermediate emulsion rag layer. Further processing of the rag layer is essential to recover the crude oil and discharge the water. The problem is faced both at production facilities and in refinery desalters.

Electrostatic demulsification in the presence of chemical demulsifiers is the most widely used technology for demulsification of water-in-crude oil emulsions.

Gravity settling and centrifugation in conjunction with chemical demulsifiers are also employed.

Recently, a microwave technology (See for example U.S. Pat. Nos. 6,086,830 and 6,077,400) patented by Imperial Petroleum Recovery Corporation has emerged for treatment of hard to treat emulsions especially the rag layer.
Thermal flash methods are also known in the art.

SUMMARY OF THE INVENTION

The instant invention includes a method for demulsifying a water-in-oil emulsion comprising the steps of:

(a) sonicating said emulsion at an energy of about 25 to about 500 watts/cm$^2$;

(b) separating said emulsion into an oil phase and an aqueous phase; and (c) recovering said phases.

The invention may further optionally comprises adding demulsifier to said emulsion prior to or during said sonication step (a).

The invention likewise includes a method for determining the strength of an interfacial film present at the oil-water interface of a water-in-oil emulsion comprising;

(a) sonicating a series of at least three samples of said water-in-oil emulsion wherein each of said samples is sonicated at an energy of at least about 25 watt/cm$^2$ higher than the preceeding sample;

(b) separating each of said sonicated water-in-oil emulsion samples into a water phase and an oil phase (c) determining the percent water separated for each of said samples in said series of samples; and (d) determining said strength of said interfacial film which strength corresponds to the energy of sonication at which the greatest percentage of water from said series of sample is separated from said water-in-oil emulsion by identifying the energy at which the greatest percentage of water was separated.

The invention also includes a method for separation of a water-in-oil emulsion in a process scheme including an on-line sonicator comprising the steps of:

(a) collecting a water-in-oil emulsion from said process scheme;

(b) sonicating said emulsion, wherein said emulsion is sonicated in a series of at least three samples and wherein each of said samples is sonicated at an energy of at least about 25 watt/cm$^2$ higher than the preceeding sample;

(c) separating each of said samples of sonicated water-in-oil emulsion into a water phase and an oil phase;

(d) determining the percent water separated for each of said samples in said series of samples; and (e) determining said strength of said interfacial film which strength corresponds to the energy of sonication at which the greatest percentage of water from said series of sample is separated from said water-in-oil emulsion by identifying the energy at which the greatest percentage of water was separated.

(f) setting the said on-line sonicator to a sonication energy level corresponding to said determined interfacial film strength: and (g) sonicating said water-in-oil emulsion in said on-line sonicator set to said determined interfacal film strength; and (h) separating said sonicated emulsion into a layer comprising water and a layer comprising oil.

DETAILED DESCRIPTION OF THE INVENTION

The invention includes a method for recovering oil from a water-in-oil emulsion. In such emulsions, particularly those containing crude oils, the organic acids, asphaltenes, basic nitrogen-containing compounds and solid particles present in the crude form an interfacial film at the water/oil interface. The instant invention affords a way to break the film and demulsify the emulsion, thereby forming a plurality of layers from which oil can be recovered.

The invention may further comprise adding a demulsifier to said water-in-oil emulsion. Use of a demulsifier is believed to weaken the interfacial film present in the emulsion with demulsifier at the oil/water interface. Such a film is weaker than the film formed absent the demulsifier. Thus, use of a demulsifier can lower the sonication energy required to break the interfacial film of the emulsion. One skilled in the art will readily recognize that the sonication energy can be lowered by use of demulsifiers and the advantages associated with their use in hard to break emulsions.

The invention is applicable to any type of water-in-oil emulsion, and is particularly suitable for solids containing water-in-oil emulsions, and is applicable to crude oil emulsions comprising components which may include solids, asphaltenes, organic acids, basic nitrogen compounds and mixtures thereof. Thus, the invention can be applied to water-in-oil emulsions of crude oils, vegetable oils, animal oils, synthetic oils and mixtures thereof. As used herein crude oils include any oils comprising organic acids, and may also contain asphaltenes, solids and basic nitrogen containing compounds. Typically, the solids, if present in the emulsion, will have an average total surface area of $\leqq 1500$ square microns, more preferably about 25 to about 1500 square microns, even more preferably about 50 to 1500 and most preferably about 100 to about 1500 square microns.

Sonication is the act of subjecting a system to sound (acoustic) waves. The velocity of sound in liquids is typically about 1500 meters/sec. Ultrasound spans the frequency of about 15 kHz to 10 MHz with associated wavelengths of about 10 to 0.02 cm. The invention may be practiced at frequencies of about 15 kHz to about 20 MHz. The output energy at a given frequency is expressed as sonication energy in units of watts/$cm^2$. The sonication provided for in the instant invention is typically accomplished at energies of about 25 to about 500 watts/$cm^2$.

Following the sonication, the sonicated emulsion is separated by methods such as centrifugation, gravity settling, hydrocyclones, application of an electrostatic field, microwave treatment or combinations thereof or by any other methods known to the skilled artisan for phase separation. The oil may then be recovered as a separate phase. Sonication alone may be sufficient to separate the emulsion into phases or may be combined with another separation method or ceased and the emulsion separated by other methods known to the skilled artisan for phase separation.

The process may be conducted at temperatures of the water-in-oil emulsion of about 20 to about 200° C. and at pressures from ambient to 200 psig (1480.4 kPa).

Use of demulsifiers in the invention is optional. If such demulsifiers are utilized, the demulsifiers may be selected from any known demulsifiers that will not degrade during sonication. Such demulsifiers can be readily selected by the skilled artisan. Typically, the demulsifiers will have a molecular weight of about 500 to about 5000, preferably about 500 to about 2000 and a hydrophilic lipophilic balance of above 9 and preferably from 9 to about 35 and most preferably from about 9 to about 15. Demulsifiers which will not degrade during sonication will not contain functional groups such as esters or amides. Demulsifiers will include, but are not limited to those which contain functional groups such as ethers, amines, ethoxylated alcohols, sulfonates and mixtures thereof. A particularly preferred demulsifier is phenolformaldehyde.

The demulsifier will be added to the emulsion prior to or during sonication. The amount of demulsifier to be added will range from about 0.1 to about 5.0 wt % based on the amount of the emulsion. Additionally, a delivery solvent may be employed. Such solvents may include crude oil distillates boiling in the range of about 70° C. to about 450° C., alcohols, ethers and mixtures thereof. Thus, the delivery solvents may be selected from the group consisting of the above.

One skilled in the art will recognize that use of a demulsifier will serve to lower the sonication energy necessary to break the interfacial film of the water-in-oil emulsion. Hence, it may be desirable to utilize a demulsifier. Furthermore, a limited number of emulsions may require the use of a demulsifier due to the strength of the interfacial film. Such emulsions will be readily identifiable to the skilled artisan since sonication alone will not break the emulsion sufficiently.

The delivery solvent will be present in an amount of from about 35 to about 75 wt % in the demulsifier. Thus, when utilized, the delivery solvent will be included in the 0.1 to 5.0 wt % demulsifier added to the emulsion.

A particularly preferred demulsifier is a phenolformaldehyde ethoxylated alcohol having the structure

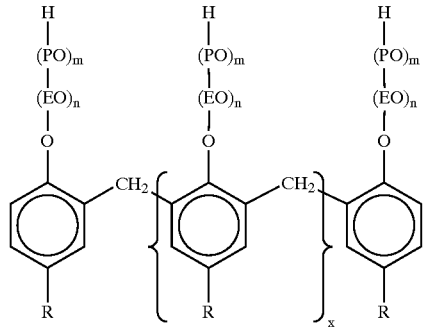

wherein R is selected from the group consisting of alkanes or alkenes from 8 to 20 carbons, E is $CH_2$—$CH_2$ and P is —$CH_2$—CH—$CH_3$, n ranges from 1 to 5, m ranges from 0 to 5 and x ranges from 3 to 9.

The invention herein described is applicable in refineries as well as in the emulsion-flooding field of operations. In a refinery, water-in-oil emulsions can form during processing of oils or may be present when crudes are shipped to the refinery for processing. Refinery desalter units would be particularly suited for separation of the emulsion once sonication is completed to coalese dispersed water droplets and recover oil.

Likewise, the invention can be applied to oil produced from subterranean formations where emulsion flooding is used to produce the oil leaving the oil to then be demulsified post-production.

Techniques for separation of the oil and water post sonication include gravity, centrifugation, electrostatic field application, hydrocyclones, microwave, and combinations thereof. The sonication which is utilized prior to separation may likewise serve to separate the emulsion, or may be used in combination with other techniques for phase separation. Such techniques are readily applied by the skilled artisan at the conditions necessary to separate the emulsion into an oil and a water phase. For example, centrifugation can be conducted at 500 to 150,000 g for about 0.1 to about 6 hours or more, and electrostatic field application of about 500–5000 volts/inch for about 0.1 to about 24 hours or more.

The invention is applicable to any water-in-oil emulsion especially those containing components such as organic acids and solids, and which may additionally include asphaltenes, basic nitrogen compounds and emulsifiers which are added or naturally present in the emulsion. Thus, the oils forming the emulsion may include crude oils, crude oil distillates, crude oil resids, or oils derived from plant or animal sources such as vegetable oils and animal oils or synthetic oils such as silicone oils. The emulsion may likewise include surfactants or other emulsifiers present in the oil or added for forming the emulsion.

The solids present can be those naturally occurring in such oils such as clay, silica, refinery coke, etc. The solids may likewise have been intentionally added to form the emulsion. When solids are present, they contribute to stabilizing the emulsion and such emulsions are referred to as solids-stabilized emulsions. Solids stabilized emulsions are difficult to demulsify by methods known in the art.

In the method for determining the strength of an interfacial film, a series of samples of the water-in-oil emulsion are treated by applying to the sample sonic energy. At least three samples will form the series. Typically, at least 3 to 5 samples, and more preferably at least 3 to 20 samples, and most preferably 3 to 10 samples will be utilized. The sonic energy is applied to each sample, with each proceeding sample being sonicated at an energy at least about 25 to about 50 watts/cm$^2$ higher than the preceeding sample. Once sonication is complete, the oil and water phases are separated and the percent demulsified or water phase separated is measured. A maximum amount of demulsification can then be identified and the energy of sonication corresponding to the amount applied to produce the highest quantity of demulsification is equivalent to the strength of the interfacial film of the emulsion. The amount of energy to be applied to the first of the series of samples is in the range of about 25 to 50 watts/cm$^2$. If the emulsion is not separable, a demulsifier should be added. A demulsifier, however will be optional in most instances.

The aqueous phase of the emulsion comprises water and may include dissolved inorganic salts of chloride, sulfates and carbonates of Group 1 and 2 elements. Organic salts can also be present in the aqueous phase.

The following examples are meant to be illlustrative and not limiting in any way.

operating at an output control setting of 4 was used and sonication conducted for 2 minutes. At the control setting of 4 the output energy is about 150 Watts/cm$^2$. The frequency of sonication was 20 kHz.

The invention was demonstrated using two crude oils, Kome and Hoosier from West Africa and Canada respectively. Hydrophobic silica sold under the trade name Aerosil R 972 by DeGussa Corporation and hydrophobic bentonite clay (prepared in the laboratory by exposing divided/delaminated clay to crude oil and air oxidation) were used as the silica and clay solids for solids stabilization of the 60/40 water-in-crude oil emulsion.

In a typical experiment 30 to 40 grams of emulsion were weighed into graduated centrifuge tubes and treated as indicted in Table-1. After treatment the tubes were centrifuged and the amount of water that broke out of the emulsion recorded.

Control experiments were those that were not subject to any treatment prior to centrifugation.

Results in Table-1 indicate that sonication by itself and in combination with demulsifier significantly enhance demulsification effectiveness.

TABLE 1

Demulsification of 60/40 Water-in-Crude Emulsion; Centrifugation for Coalescence of Dispersed Water

| Crude Oil | Water | Solids | Demulsifier BASF Pluradyne | Sonication 150 Watts/cm^2 | Demulsification % Brine Breakout |
|---|---|---|---|---|---|
| Kome | Kome Brine | Silica | None | None | 0 |
| Kome | Kome Brine | Silica | 0.5 wt % | None | 0 |
| Kome | Kome Brine | Silica | None | 2 minutes | 31 |
| Kome | Kome Brine | Silica | 0.5 wt % | 2 minutes | 97 |
| Kome | Kome Brine | Clay | 0.5 wt % | 2 minutes | 99 |
| Hoosier | Hoosier Brine | Silica | None | None | 0 |
| Hoosier | Hoosier Brine | Silica | 0.5 wt % | None | 37 |
| Hoosier | Hoosier Brine | Silica | None | 2 minutes | 50 |
| Hoosier | Hoosier Brine | Silica | 0.5 wt % | 2 minutes | 99 |
| Hoosier | Hoosier Brine | Clay | 0.5 wt % | 2 minutes | 99 |

EXAMPLE-1

Demulsification of 60/40 Water-In-Crude Oil Emulsion Stabilized by Solids (Centrifugation for Coalescence of Water Droplets of Emulsion)

The general procedure to prepare a 60/40 water-in-crude oil emulsion involved adding 0.15 wt % of solids to the oil followed by addition of water or brine and mixing. A Silverson mixer supplied by Silverson Machines, Inc. East Longmeadow, Mass. was used. Mixing was conducted at 25° C. and at 400 to 600 rpm for a time required to disperse all the water into the oil. Water was added to the crude oil in aliquots spread over 5 additions. When demulsifier was used, it was added to the emulsion at a treat rate of 0.5 wt % demulsifier formulation based on the weight of emulsion and mixed with a Silverson mixer at 400 to 600 rpm for 10 to 15 minutes. A phenol formaldehyde ethoxylated alcohol demulsifier formulation sold by BASF Corporation as Pluradyne DB7946 was used to demonstrate the invention.

Centrifugation was conducted at 25° C. using a Beckman L8-80 Ultracentrifuge at 10,000 rpm (7780 g) for 30 minutes to effect separation of the water and oil phases. Sonication was conducted using a Sonifier Model 350. The pulse mode

EXAMPLE-2

Demulsification of 20/80 Water-In-Crude Oil Emulsion (Electrostatic Coalescence of Water Droplets of Emulsion)

The general procedure to prepare a 20/80 water-in-crude oil emulsion involved addition of water or brine to the crude oil and mixing. A Silverson mixer supplied by Silverson Machines, Inc. East Longmeadow, Mass. was used. Mixing was conducted at 25° C. and at 400 to 600 rpm for a time required to disperse all the water into the oil. Water was added to the crude oil in aliquots spread over 5 additions. When demulsifier was used, it was added to the emulsion at a treat rate of 0.5 wt % demulsifier formulation based on the weight of emulsion and mixed with a Silverson mixer at 400 to 600 rpm for 10 to 15 minutes. A phenol formaldehyde ethoxylated alcohol demulsifier formulation sold by BASF Corporation as Pluradyne DB7946 was used to demonstrate the invention.

Electrostatic demulsification was conducted using a model EDPT-128™ electrostatic dehydrator and precipitation tester available from INTER-AV, Inc., San Antonio, Tex. Demulsification was conducted at an 830 volt/inch potential for 30 to 180 minutes at temperatures of 60 and 85° C. Sonication was conducted using a Sonifier Model 350. The pulse mode operating at an output control setting of 4 was used and sonication conducted for 2 minutes. At the control setting of 4, the output energy is about 150 watts/$cm^2$. The frequency of sonication was 20 kHz.

Two crude oils, Kome and Hoosier from West Africa and Canada respectively were utilized. Hydrophobic silica sold under the trade name Aerosil R 972 by DeGussa Corporation was used for solids stabilization of the Hoosier oil.

In a typical experiment 30 to 40 grams of emulsion was weighed into graduated electrostatic demulsification tubes and treated as indicted in Table-1. After electrostatic treatment, the amount of water that separated out of the emulsion was recorded.

Control experiments were those that were not subject to any treatment prior to electrostatic demulsification.

Results in Table-2 indicate that sonication by itself and in combination with demulsifier significantly enhance demulsification effectiveness. Comparison of results in Tables 1 and 2 indicate that laboratory centrifugation was more effective in coalescing the water droplets than the laboratory electrostatic desalter. Field electrostatic desalters operating at higher electrostatic fields are known to improve separation effectiveness over those observed in laboratory instruments.

TABLE 2

| Demulsification of 20/80 Water-in-Crude Emulsion; Electrostatic Coalescence of Dispersed Water | | | | | |
|---|---|---|---|---|---|
| Crude Oil | Water | Solids | Demulsifier BASF Pluradyne | Sonication 150 Watts/cm^2 | Demulsification % Brine Breakout |
| Kome | Kome Brine | None | None | None | 4 |
| Kome | Kome Brine | None | 0.5 wt % | None | 75 |
| Kome | Kome Brine | None | None | 2 minutes | 19 |
| Kome | Kome Brine | None | 0.5 wt % | 2 minutes | 94 |
| Hoosier | Hoosier Brine | Silica | None | None | 4 |
| Hoosier | Hoosier Brine | Silica | 0.5 wt % | None | 5 |
| Hoosier | Hoosier Brine | Silica | None | 2 minutes | 50 |
| Hoosier | Hoosier Brine | Silica | 0.5 wt % | 2 minutes | 75 |

Example for Interfacial Film Strength Determination:

A 30/70 water-in-crude oil emulsion was prepared by adding 0.15 wt % of hydrophobic silica solids to a Tulare crude oil followed by addition of Tulare brine and mixing. A Silverson mixer supplied by Silverson Machines, Inc. East Longmeadow, Mass. was used. Mixing was conducted at 25° C. and at 400 to 600 rpm for a time required to disperse all the water into the oil. The brine was added to the crude oil in aliquots spread over 5 additions.

The prepared emulsion was divided into eight samples 6 g each into eight graduated tubes.

Sample #1 was the control sample that was not sonicated.

Samples #2, #3, #4, #5, #6, #7 and #8 were sonicated at 50, 100, 150, 200, 250, 300 and 350 Watts/square cm respectively for 2 minutes each. Sonication was conducted using a Sonifier Model 350 in the pulse mode.

After sonication samples #1 through #8 were centrifuged. Centrifugation was conducted at 25° C. using a Beckman L8-80 Ultracentrifuge at 2,000 rpm (1550 g) for 30 minutes to effect separation of the water and oil phases. After centrifugation the amount of brine separating out was recorded. Results are shown in Table-3.

TABLE 3

| Sample # | Sonication Energy (watts/$cm^2$) | % Brine Separated |
|---|---|---|
| 1 | None | 44 |
| 2 | 50 | 83 |
| 3 | 100 | 72 |
| 4 | 150 | 44 |
| 5 | 200 | 11 |
| 6 | 250 | 6 |
| 7 | 300 | 6 |
| 8 | 350 | 6 |

The interfacial film strength is in the range of 50 to 100 watts/$cm^2$.

What is claimed is:

1. A method for determining a strength of an interfacial film present at an oil-water interface of a water-in-oil emulsion comprising;

(a) sonicating a series of at least three samples of said water-in-oil emulsion wherein each of said samples is sonicated at an energy of at least about 25 watt/$cm^2$ higher than the preceeding sample;

(b) separating each of said sonicated water-in-oil emulsion samples into a water phase and an oil phase;

(c) determining the weight of water separated for each of said samples in said series of samples;

(d) calculating a weight percent of water separated for each of said samples in said series of samples said weight percent is the percent demulsification;

(e) identifying a sample exhibiting maximum percent demulsification from said series of samples and the energy of sonication corresponding to the said sample exhibiting maximum percent demulsification is the strength of the interfacial film of the emulsion.

2. The method of claim 1 further comprising adding demulsifier to said emulsion prior to or during said sonication step (a).

3. The method of claim 1 wherein said demulsifier is selected from demuilsifiers having a molecular weight of about 500 to about 5000 and a hydrophilic lipophilic balance of about 9 to about 35.

4. The method of claim 1 wherein said demulsifier is a phenolformaldehyde ethoxylated alcohol having the formula:

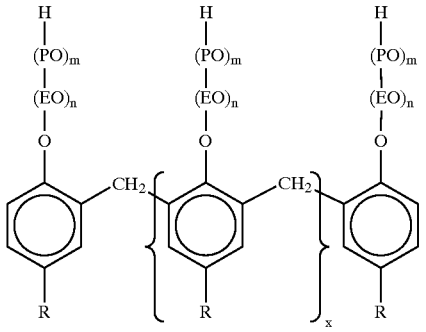

wherein R is selected from the group consisting of alkanes, alkenes, or mixtures thereof from 8 to 20 carbons, E is $CH_2$—$CH_2$ and P is —$CH_2$—CH—$CH_3$, n ranges from 1 to 5, m ranges from 0 to 5 and x ranges from 3 to 9.

5. The method of claim 1 wherein said demulsifier comprises demulsifier and about 35 wt % to about 75 wt % of a solvent selected from the group consisting of crude oil distillates, alcohols, ethers or mixtures thereof.

6. The method of claim 1 wherein the demulsifier is present in an amount from 0.01 to 5.0 wt % based on the weight of emulsion.

7. The method of claim 1 wherein the oil of said water-in-oil emulsion is selected from crude oil, crude oil distillate, crude oil resid, vegetable oil, animal oil, synthetic oil and mixtures thereof.

8. The method claim 1 wherein the method is conducted at a temperature of about 20 to about 200° C.

9. The method of claim 1 wherein said separation is accomplished by centrifugation, hydrocyclones, microwave, electrostatic field, sonication, gravity settling and combinations thereof.

10. The method of claim 9 wherein said centrifugation is conducted using a field which ranges from 500 to 150,000 g for a time from 0.1 to 6 hours.

11. The method of claim 9 wherein said electrostatic field ranges from about 500 to about 5000 volts per inch for a time from 0.1 to 24 hours.

12. The method of claim 1 wherein said water of said water-in-oil emulsion contains dissolved inorganic salts of chloride, sulfates or carbonates of Group 1 and 2 elements.

13. The method of claim 1 wherein said emulsion contains solids.

14. The method of claim 1 wherein said solids have an average total surface area of <1500 square microns.

15. The method of claim 13 wherein said solids are selected from the group consisting of hydrophobic silica, hydrophobic clay, refinery coke and mixtures thereof.

16. The method of claim 15 wherein said hydrophobic clay is hydrophobic bentonite clay.

17. The method of claim 1 wherein said sonication is conducted at frequencies of about 15 kHz to about 10 MHz.

18. The method of claim 1 wherein said sonication is conducted in continuous or pulse mode.

19. A method for separation of a water-in-oil emulsion in a process scheme including an on-line sonicator comprising the steps of:

(a) collecting a water-in-oil emulsion from said process scheme;

(b) sonicating said emulsion, wherein said emulsion is sonicated in a series of at least three samples and wherein each of said samples is sonicated at an energy of at least about 25 watt/$cm^2$ higher than the preceding sample;

(c) separating each of said samples of sonicated water-in-oil emulsion into a water phase and an oil phase;

(d) determining the weight of water separated for each of said samples in said series of samples;

(e) calculating a weight percent of water separated for each of said samples in said series of samples said weight percent is the percent demulsification;

(f) identifying a sample exhibiting maximum percent demulsification from said series of samples and the energy of sonication corresponding to the said sample exhibiting maximum percent demulsification is the strength of the interfacial film of the emulsion.

(g) setting the said on-line sonicator to a sonication energy level corresponding to the interfacial film strength; and (h) sonicating said water-in-oil emulsion in said on-line sonicator set to interfacial film strength; and (i) separating said sonicated emulsion into a layer comprising water and a layer comprising oil.

* * * * *